US005181582A

United States Patent [19]

Meadows

[11] Patent Number: 5,181,582

[45] Date of Patent: Jan. 26, 1993

[54] SCAFFOLD FOR AN A-FRAME LADDER

[76] Inventor: Merman R. Meadows, Rt. 10, Box 137, Mooresville, N.C. 28115

[21] Appl. No.: 794,507

[22] Filed: Nov. 19, 1991

[51] Int. Cl.[5] ..... E06C 7/16

[52] U.S. Cl. ..... 182/121; 182/105; 182/116; 248/238

[58] Field of Search ..... 182/121, 122, 120, 116, 182/105, 182; 248/238

[56] References Cited

U.S. PATENT DOCUMENTS

| | | | |
|---|---|---|---|
| 96,495 | 11/1969 | Smith | 182/116 |
| 487,301 | 12/1892 | Sorg | 182/105 |
| 610,487 | 9/1898 | Hoover | 182/105 |
| 886,737 | 5/1908 | Taylor | 182/120 |
| 2,581,027 | 1/1952 | Keest | 182/122 |
| 2,606,079 | 8/1952 | White | 182/121 |
| 2,730,412 | 1/1956 | Yoder | 182/120 |
| 4,211,307 | 7/1980 | Ethridge | 182/121 |
| 4,533,018 | 8/1985 | Tyson | 182/121 |

*Primary Examiner*—Reinaldo P. Machado

*Attorney, Agent, or Firm*—W. Thad Adams, III

[57] ABSTRACT

A scaffold for an A-frame ladder, including a platform for being positioned between two legs of the ladder, supported on a bottom side of the platform intermediate two opposing ends thereof by a rung of the ladder and extending outwardly from opposite sides of the ladder. The scaffold includes a first strut pivotally attached to the bottom side of the platform adjacent one end thereof and extending diagonally downward for engagement with a rung of the ladder below the rung supporting the bottom side of the platform, and a second strut pivotally attached to the bottom side of the platform adjacent the other end and extending diagonally downward for engagement with the rung of the ladder with which the first strut is engaged. A third strut is attached to the bottom side of the platform adjacent the one end thereof in lateral spaced-apart relation to the first strut and extends diagonally downward for engagement with the rung of the ladder with which the first and second struts are engaged, in lateral spaced apart relation to both first and second struts.

8 Claims, 3 Drawing Sheets

SCAFFOLD FOR AN A-FRAME LADDER

TECHNICAL FIELD AND BACKGROUND OF THE INVENTION

This invention relates to a scaffold for an A-frame ladder. An A frame ladder is a ladder which has two lengths of ladder which converge in the upward direction. At the point of convergence another ladder segment extends vertically-upward and is vertically adjustable by an extension mechanism. This type of ladder is particularly useful because it need not be tilted or propped against a structure, and is quite stable in use.

However, this ladder, like most ladders, have relatively narrow rungs which can cause foot fatigue after hours of use. Rungs also do not provide a broad, stable platform for the feet, particularly when it is necessary to move about while working. This invention provides a safe, lightweight and portable scaffold which can be used on A-frame ladders of many different sizes and types.

SUMMARY OF THE INVENTION

Therefore, it is an object of the invention to provide a scaffold for an A-frame ladder which is portable.

It is another object of the invention to provide a scaffold for an A-frame ladder which is adjustable for many different sizes and types of A-frame ladders.

It is another object of the invention to provide a scaffold for an A-frame ladder which provides a support surface on opposite sides of the ladder.

These and other objects of the present invention are achieved in the preferred embodiments disclosed below by providing a scaffold for an A-frame ladder, comprising a platform for being positioned between two legs of the ladder, supported on a bottom side of the platform intermediate two opposing ends thereof by a rung of the ladder and extending outwardly from opposite sides of the ladder. The scaffold includes a first strut pivotally attached to the bottom side of the platform adjacent one end thereof and extending diagonally downward for engagement with a rung of the ladder below the rung supporting the bottom side of the platform, and a second strut pivotally attached to the bottom side of the platform adjacent the other end thereof and extending diagonally downward for engagement with the rung of the ladder with which the first strut is engaged.

Preferably, a third strut is attached to the bottom side of the platform adjacent the one end thereof in lateral spaced-apart relation to the first strut and extends diagonally downward for engagement with the rung of the ladder with which the first and second struts are engaged, in lateral spaced apart relation to both first and second struts.

According to one preferred embodiment of the invention, the scaffold includes locking means positioned on the bottom of the platform for being positioned over the rung of the ladder supporting the platform for preventing movement of the platform from one side of the ladder to the other.

According to another preferred embodiment of the invention, the end of the platform extends outwardly on one side of the ladder and is wider than the end of the platform extending outwardly on the other side of the ladder and is also wider than the ladder between the two legs thereof. The other end of the platform is narrower than the ladder between the two legs, thereby permitting the platform to being passed between the legs of the ladder into position.

According to yet another preferred embodiment of the invention, including adjustment means cooperate with each of the first and second struts for lengthening or shortening the first and second struts as required to accommodate ladders having rungs different distances apart.

According to one preferred embodiment of the invention, adjustment means are provided and cooperate with each of the first, second and third struts for lengthening or shortening the first, second and thirds struts as required to accommodate ladders having rungs different distances apart.

According to another preferred embodiment of the invention, the struts include notches in the bottom of each of them for being positioned over the rung of the ladder.

According to yet another preferred embodiment of the invention, the adjustment means comprises first and second strut segments and a threaded rod positioned in opposing threaded ends of the first and second strut segments.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
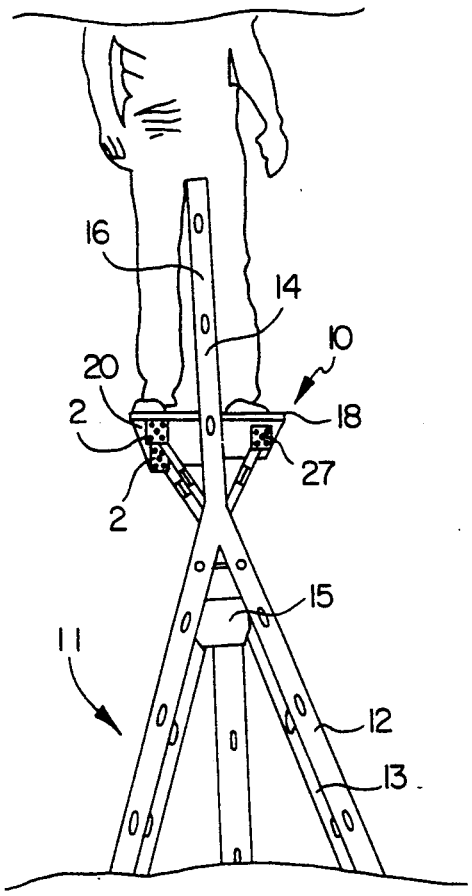
FIG. 1 is a side elevation view of the scaffold according to an embodiment of the invention.
Figure 5:
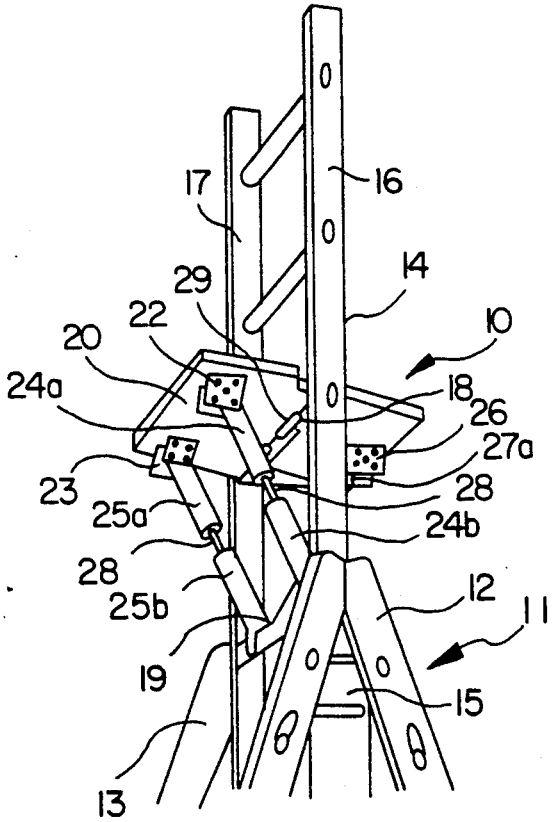
FIG. 5 is a perspective view of the scaffold shown in FIG. 1 from the underside showing the details of the underside of the scaffold.

Referring now specifically to the drawings, a scaffold according to the present invention is illustrated in FIG. 1 and shown generally at reference numeral 10. The scaffold 10 is intended for use on an A-frame ladder 11. As is best shown in FIG. 5, the ladder 11 is constructed of two lengths of ladder 12 and 13 which converge upwardly where they are connected together to form an A-shaped structure. At their point of convergence, a vertical ladder 14 extends upwardly. Vertical ladder 14 can be adjusted upwardly or downwardly as needed by means of an extension mechanism 15. Ladder 14 has two laterally-spaced apart legs 16, 17 and vertically-spaced apart rungs. Those which support the scaffold 10 are referenced as 18 and 19.

Figure 2:
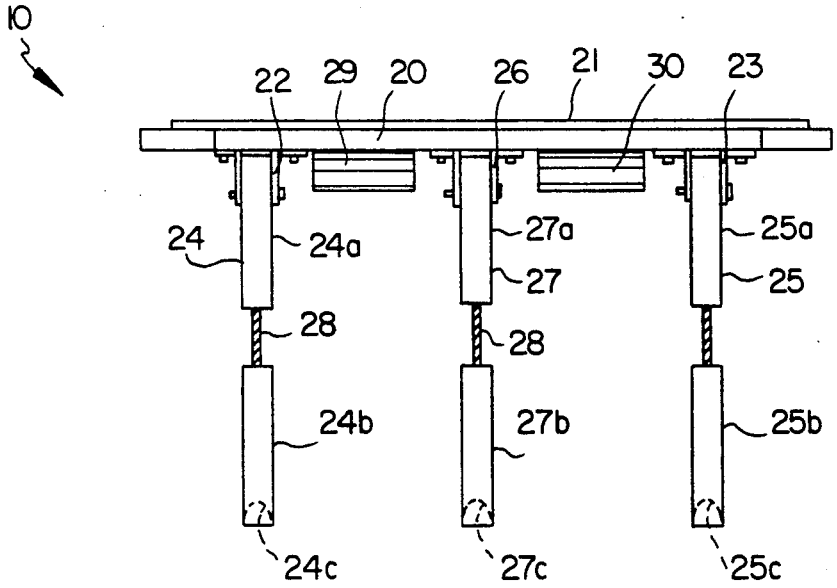
FIG. 2 is an end elevation of the scaffold shown in FIG. 1.
Figure 4:
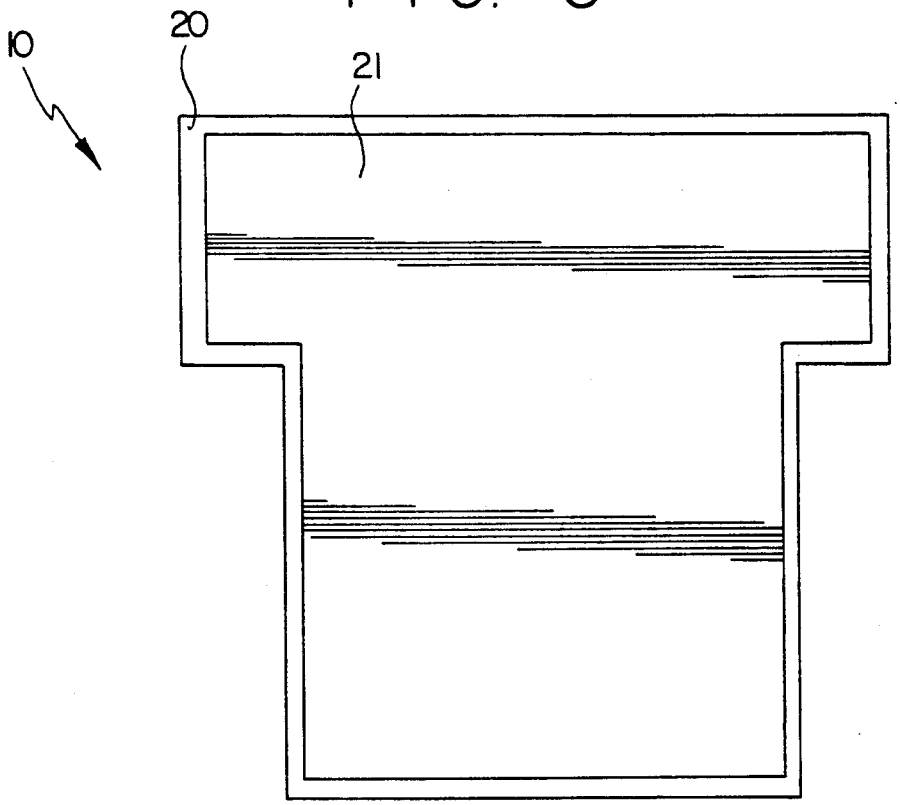
FIG. 4 is a top plan view of the scaffold shown in FIG. 1.

Referring now to FIG. 2, scaffold 10 is constructed of a platform 20 which can be fabricated of ¾ inch plywood, or can be cast of metal, such as aluminum. Preferably, the top surface of platform is covered with a rubber non-skid mat 21. As is best shown in FIG. 4, platform 20 is shaped so that one side is wider than the distance between the two legs 16, 17 of the ladder 14. The other side is sufficiently narrow so that it can fit through the space between the legs 16, 17 without having to insert it diagonally within the space between two vertical rungs. The platform 20 therefore provides a relatively wide, secure foot support on both sides of the ladder.

As is best shown in FIG. 2, two brackets 22 and 23 are bolted in laterally spaced-apart relation to the bottom surface of platform 20 on the wider side. A strut 24 is secured by a bolt to the bracket 22 and is permitted to pivot inwardly. Likewise, a strut 25 is secured by a bolt to the bracket 23 and is permitted to pivot inwardly. A bracket 26 is bolted to the underside of platform 20 on its narrow side, essentially in the middle between brackets 22 and 23. Each of the three struts 24, 25 and 27 are comprised of two strut segments 24*a*,24*b*, 25*a*,25*b*, and 27*a*,27*b*. Each of the pairs of strut segments 24*a*,24*b*, 25*a*,25*b*, and 27*a*,27*b* are connected by respective threaded rods 28. Threaded rods 28 are threaded into nuts (not shown) which may preferably be welded into the ends of strut segments 24*a*,24*b*, 25*a*,25*b*, and 27*a*,27*b*. The bottom of each of the struts 24, 25 and 27 are notched with notches 24*c*, 25*c*, 27*c* at their respective ends so that the rung 19 fits into the notches and secures the platform into place.

A pair of locking means, comprising semi-circular metal brackets 29, 30 are attached to the bottom of platform 20 and extend laterally in alignment with rung 18. Rung 18 fits into the brackets 29, 30 and prevents shifting of the platform 20 as weight on the platform is shifted. These brackets 29, 30 work together with the struts 24, 25 and 27 and the shoulder at the juncture of the wide and narrow sides of platform 20 to insure a very stable scaffold.

Figure 3:
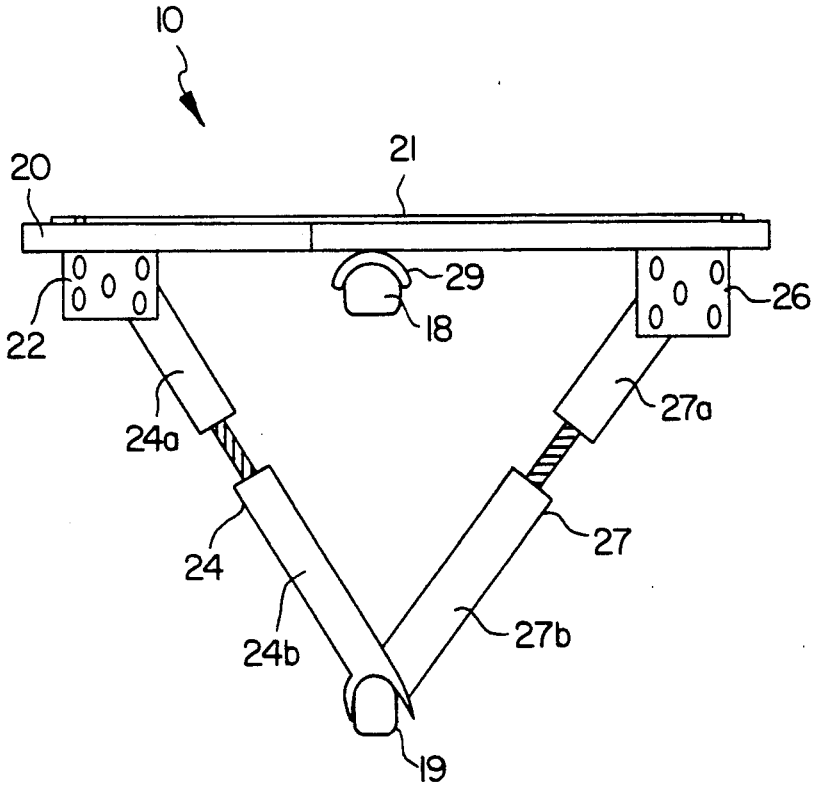
FIG. 3 is a side elevation of the scaffold shown in FIG. 1.

As is shown in FIGS. 1 and 3, struts 24, 25 extend inwardly and downwardly in a diagonal direction and lock into place over rung 19 from the wide side of platform 20. Strut 27 extends inwardly and downwardly in a diagonal direction and locks into place over rung 19 from the narrow side of platform 20. If necessary to accommodate differing distances between rungs, the strut segments 24*b*, 25*b* and/or 27*b* are turned in the appropriate direction to lengthen or shorten the overall length of the struts 24, 25 and/or 27.

According to the best mode of the invention, the platform 20 is constructed of ¾ inch plywood, although other materials may be used. The struts 24, 25 and 27 are fabricated of 1-inch square or round tubing.

The scaffold 10 is easily installed by folding the struts 24, 25, 27 upwardly slightly and extending the narrow side through and between the legs 16, 17 of the ladder 14 until the shoulder at the junction of the narrow and wide side abuts the legs 16, 17. Platform 20 is lowered so that brackets 29, 30 rest over rung 18 and the struts 24, 25, 27 are extended so that rung 19 fits into notches 24*c*, 25*c* and 27*c*, respectively.

A ladder scaffold for an A-frame is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. A scaffold for an A-frame ladder, comprising:

(a) a platform for being positioned between two legs of the ladder, supported on a bottom side of the platform intermediate two opposing ends thereof by a rung of the ladder and extending outwardly from opposite sides of the ladder;

(b) a first strut pivotally attached to the bottom side of the platform adjacent one end thereof and extending diagonally downward for engagement with a rung of the ladder below the rung supporting the bottom side of the platform; and (c) a second strut pivotally attached to the bottom side of the platform adjacent the other end thereof and extending diagonally downward for engagement with the rung of the ladder with which the first strut is engaged.

2. A scaffold according to claim 1, and including a third strut attached to the bottom side of the platform adjacent said one end thereof in lateral spaced-apart relation to said first strut and extending diagonally downward for engagement with the rung of the ladder with which the first and second struts are engaged, in lateral spaced apart relation to both first and second struts.

3. A scaffold according to claim 1, and including locking means positioned on the bottom of the platform for being positioned over the rung of the ladder supporting the platform for preventing movement of the platform from one side of the ladder to the other.

4. A scaffold according to claim 1, wherein the end of the platform extending outwardly on one side of the ladder is wider than the end of the platform extending outwardly one the other side of the ladder and also wider than the ladder between the two legs thereof, and the other end of the platform narrower than the ladder between the two legs thereof thereby permitting the platform to being passed between the legs of the ladder into position.

5. A scaffold according to claim 1, and including adjustment means cooperating with each of the first and second struts for lengthening or shortening said first and second struts as required to accommodate ladders having rungs different distances apart.

6. A scaffold according to claim 2, and including adjustment means cooperating with each of the first, second and third struts for lengthening or shortening said first, second and thirds struts as required to accommodate ladders having rungs different distances apart.

7. A scaffold according to claim 1, and including notches in the bottom of each of the struts for being positioned over the rung of the ladder.

8. A scaffold according to claim 6, wherein said adjustment means comprises first and second strut segments and a threaded rod positioned in opposing threaded ends of said first and second strut segments.

* * * * *